US006894951B1

(12) United States Patent
Brandt et al.

(10) Patent No.: US 6,894,951 B1
(45) Date of Patent: May 17, 2005

(54) WATCH MOVEMENT WITH HAND DISPLAY

(75) Inventors: Charles Brandt, Corgémont (CH); Pierre Jeannet, Chambrelien (CH)

(73) Assignee: Eberhard et Co. SA, Bienne (CH)

( * ) Notice: Subject to any disclaimer, the term of this patent is extended or adjusted under 35 U.S.C. 154(b) by 0 days.

(21) Appl. No.: 10/070,934

(22) PCT Filed: Mar. 9, 2000

(86) PCT No.: PCT/IB00/00244

§ 371 (c)(1),
(2), (4) Date: Mar. 11, 2002

(87) PCT Pub. No.: WO01/20408

PCT Pub. Date: Mar. 22, 2001

(30) Foreign Application Priority Data

Sep. 15, 1999 (CH) ..... MM126349

(51) Int. Cl.[7] ..... G04B 19/04; G04B 25/00; G04F 10/00; G04C 17/00

(52) U.S. Cl. ..... 368/80; 368/110; 368/220; 368/223

(58) Field of Search ..... 368/76, 80, 110–113, 368/223, 228

(56) References Cited

U.S. PATENT DOCUMENTS 2,361,563 A * 10/1944 Pellaton ..... 368/80
4,523,857 A * 6/1985 Ushikoshi ..... 368/157
5,113,381 A * 5/1992 Sakamoto et al. ..... 368/74
5,339,293 A * 8/1994 Kamiyama et al. ..... 368/21
5,724,317 A * 3/1998 Kubota et al. ..... 368/11
5,739,647 A 4/1998 Taghezout
D444,715 S * 7/2001 Gueit ..... D10/32
6,570,823 B1 * 5/2003 Gilomen et al. ..... 368/113

FOREIGN PATENT DOCUMENTS

EP 0 389 440 A1 9/1990

* cited by examiner

*Primary Examiner*—Vit W. Miska
(74) *Attorney, Agent, or Firm*—McGlew and Tuttle, P.C.

(57) ABSTRACT

Watch movement with hand display, comprising mobile elements (44, 42), designed to receive the hour (16) and minute (20) hands indicating current time, mounted pivoting to pivot about a first axis (A—A) arranged substantially at the center of the movement and four mobile elements (58*b*, 60*b*, 64*b*, 62*b*) designed to receive hands displaying complementary functions.

According to the invention, the four mobile elements (58*b*, 60*b*, 64*b*, 62*b*) are mounted pivoting on the movement about second (B—B), third (C—C), fourth (ND) and fifth (E—E) axes arranged on a straight line (X—X) perpendicular to them.

16 Claims, 3 Drawing Sheets

Figure 2
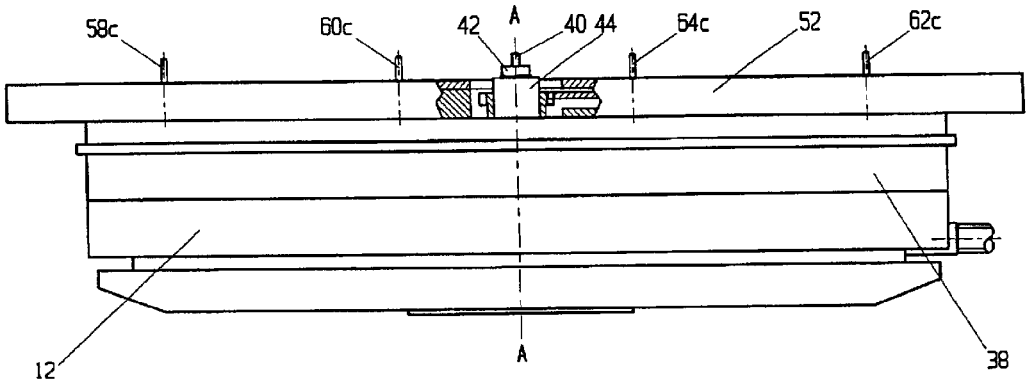
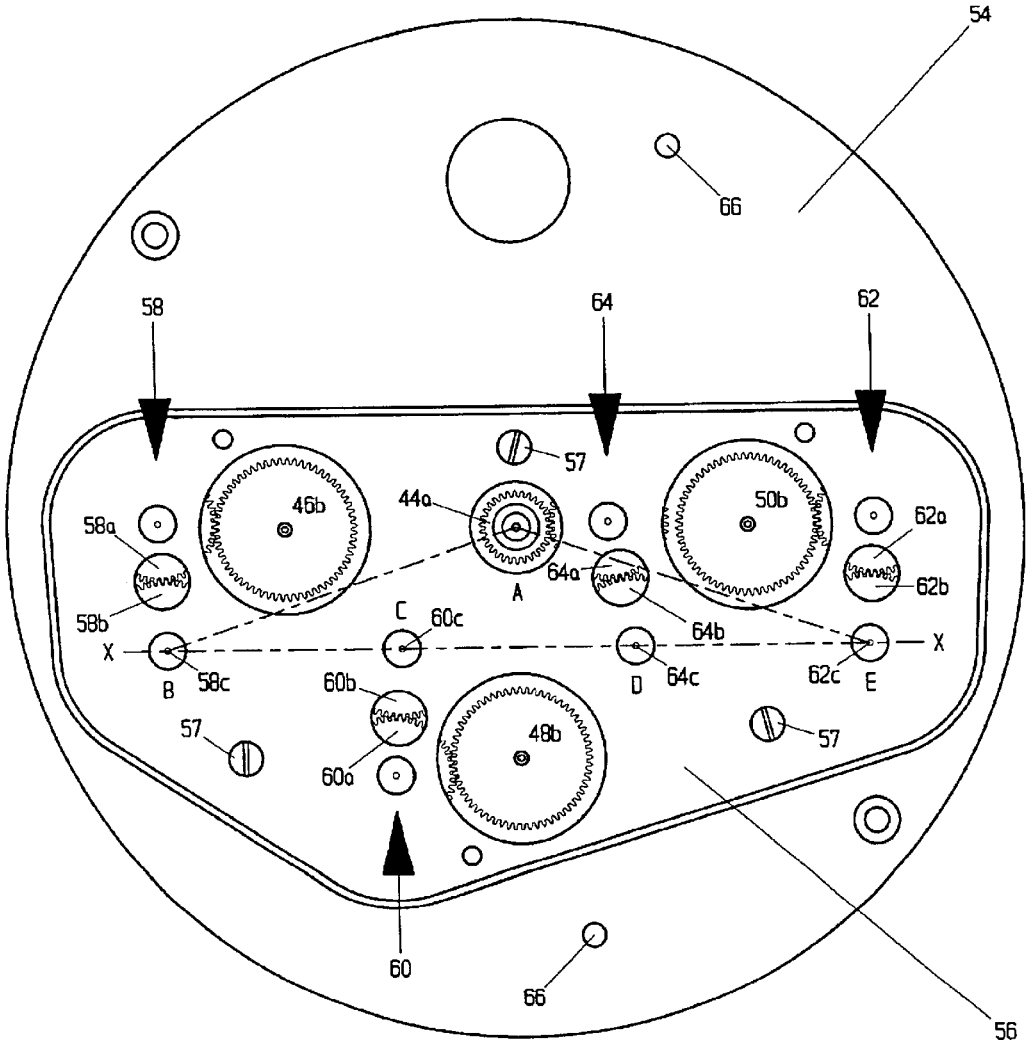
Figure 3

WATCH MOVEMENT WITH HAND DISPLAY

FIELD OF THE INVENTION

The present invention concerns watch movements with hand display, and more particularly, those of the type with complications. A watch movement with complications means a movement allowing functions other than the date to be displayed, which are generally the day of the month, the day of the week, the hour, the minute and the second. This is the case, in particular, of watches known by the name of chronographs, which allow a time counter to be started at a given moment, and stopped, restarted or reset to zero at any time.

BACKGROUND OF THE INVENTION

Watches made using of these movements include, conventionally, a display of the hour and minute of the current time by means of hands arranged at the centre of the dial. The seconds hand of the chronograph is concentric thereto. Other data is displayed by means of hands. This is generally the second of the current time, and the measured hour and minute. They are displayed by means of small hands whose pivoting axis is generally at a distance from the central axis substantially equal to half the radius of the dial. If the dial is not round, this distance is substantially equal to half the radius of a circle inscribed in the periphery of the dial.

The watch dial thus includes up to four small dials arranged generally at midday, 3, 6 and 9 o'clock. Watches of this type are illustrated at pages 283 and 285 of the catalogue of works selected from the Musée International d'Horologerie, La Chaux-de-Fonds 1999 ISBN 2-940088-07-1. It will be noted that practically the entire visible surface is occupied by the display of the various functions. This results in a heaviness that is detrimental to the aesthetic appearance of the watch.

Moreover, very particular care is required to read the data displayed, since the eye has to follow a circular movement in order to read the four small hands.

The object of the present invention is to allow the manufacture of watches that include a significant number of complications, offering a display that is pleasant to read and which avoids overloading the dial.

BRIEF SUMMARY OF THE INVENTION

The watch movement according to the invention thus has a hand display, including mobile elements, intended to receive the hour and minute hands of the current time, mounted so as to pivot about a first arbour arranged substantially at the centre of the movement and four mobile elements intended to receive hands for displaying complementary functions.

The watch movement is characterised in that the four mobile elements are mounted so as to pivot on the movement about second, third, fourth and fifth axes arranged on a straight line which is perpendicular to them, the second and fifth axes forming with the first axis the apex of an isosceles triangle the base of which rests on said straight line, the angle at the apex being comprised between 120° and 180°.

Horological mobile element arbours aligned along a straight line have of course already been shown. Thus, European Patent document No. EP-A-0 389 440 includes a block diagram of a watch movement provided with four hands. In this diagram, the hands are shown on a line. However, in the Figure showing the structure of the watch, the axes of the arbours bearing the hands are arranged concentric to the centre of the movement.

US Patent document No. U.S. Pat. No. 5,739,647 relates to a transducer intended to be fitted to a watch and including several rotors, certain embodiments showing them aligned. The gear trains driven by these rotors are not, however, shown.

Advantageously, the straight line passing through the second to fifth axes is arranged below a line passing from 3 to 9 o'clock, through the centre of the movement.

Experience has shown that, advantageously, the angle at the apex is substantially equal to 140°.

One particularly attractive solution relates to a chronograph type movement, which includes a mobile element intended to carry a second hand for the measured time concentric to the hour and minute hands. Among the four mobile elements whose axes are arranged in a line, three of them are intended to display respectively the minute and hour of the measured time and the second of the current time. The fourth mobile element may be intended to display the 24 hours of the day.

It is well known that the construction and industrialisation of a watch movement, and even more so a chronograph, requires a large investment of time and money. Thus, in order to allow the subject of the invention to be implemented quickly and economically, it is advantageous for the movement to include a plate intended to carry its various components and for the four mobile elements, whose axes are aligned, to be arranged on a module, itself mounted on the plate, each of the four mobile elements being kinematically connected to a mobile element pivoting in the plate.

BRIEF DESCRIPTION OF THE DRAWINGS

Other advantages and features of the invention will appear from the following description, made with reference to the annexed drawing, in which:

1.

2. FIGS. 2 and 3 are respectively side and top views of the movement according to the invention; and 3.

DETAILED DESCRIPTION OF AN EMBODIMENT OF THE INVENTION

Figure 1:
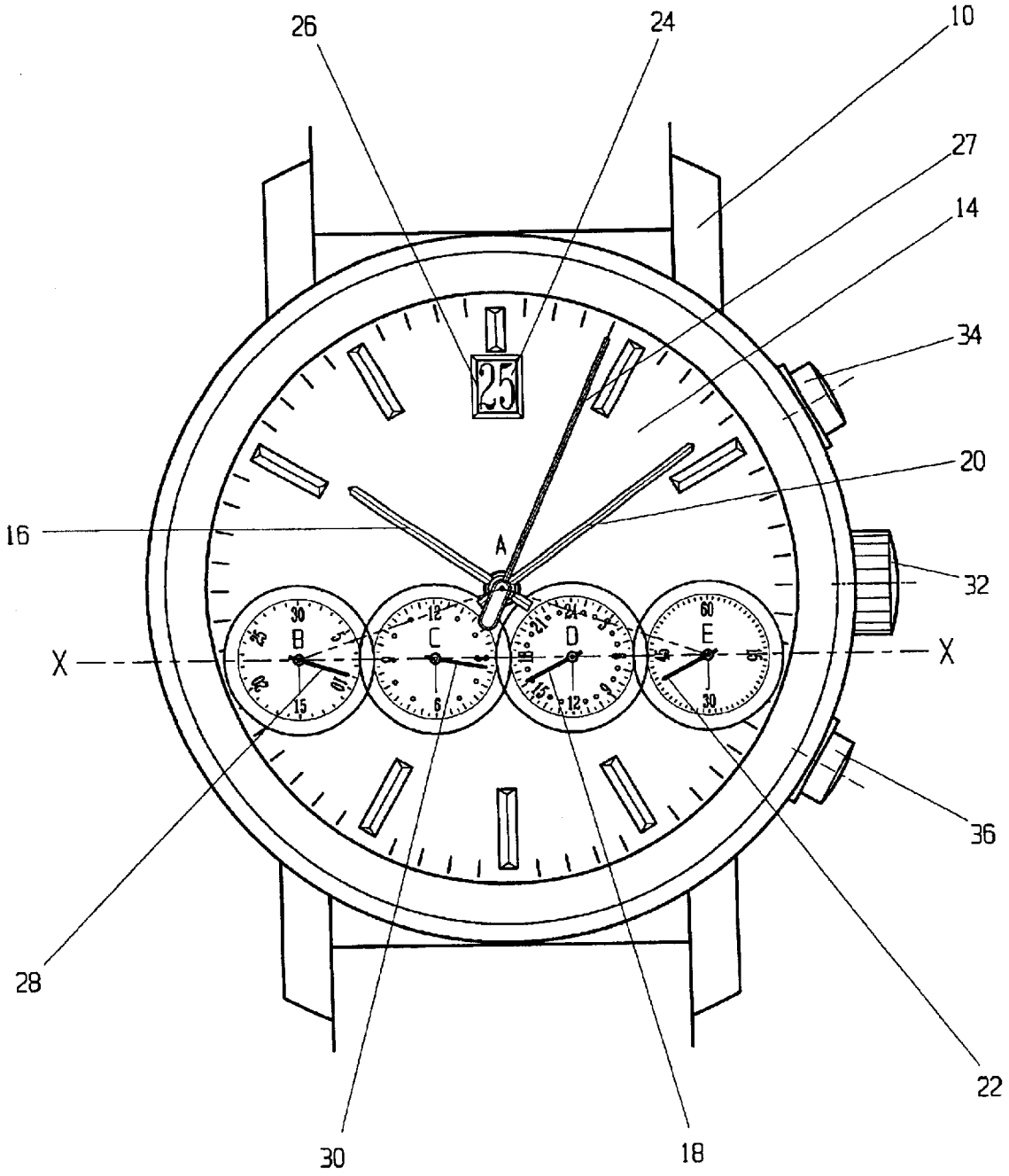
FIG. 1 shows a watch fitted with a movement according to the invention.

The watch shown in FIG. 1 is a chronograph type watch. It includes, in a conventional manner, a case 10 which houses a movement 12, not visible in FIG. 1, and which will only be described with reference to FIGS. 2 and 3.

The movement carries a dial 14 on which are arranged hands for displaying current time information, namely an hour hand 16 completing one revolution in 12 hours, an hour hand 18 completing one revolution in 24 hours, a minute hand 20 and a second hand 22. This display is completed by the day of the month indication 24, which appears through an aperture 26 made at midday in dial 14. Hour hand 16 and minute hand 20 are arranged at the centre of dial 14 and rotate about an axis A—A perpendicular to the plane of the drawing in FIG. 1.

The watch further includes three chronograph hands 27, 28 and 30, respectively displaying the seconds, minutes and hours of measured times.

In order to control the watch, the user has a crown 32, placed at 3 o'clock, which enables time setting to be assured, and, in mechanical watches, the mainspring to be wound. Moreover, two push buttons 34 and 36, arranged respectively at 2 and 4 o'clock allow the chronograph functions to be controlled in a conventional manner.

As is shown clearly in FIG. 1, hands 28, 30, 18 and 22 pivot respectively about axes B—B, C—C, D—D and E—E which, in FIG. 1, are perpendicular to the plane of the drawing and arranged in a line, so that it is possible to pass a straight line X—X through the points of intersection B, C, D and E of these axes with the plane of the drawing. Moreover, if the end points B and E, corresponding to axes BOB and E—E are connected to point A corresponding to axis A—A, this defines an isosceles triangle whose angle at apex A is substantially equal to 140°. This solution permits an entirely legible display while giving the dial a certain aesthetic (bearing) due to the fact that the graphic structures arranged on the dial and defining the scales of hands 28, 30, 18 and 22 are arranged below axis A—A, i.e. substantially on a straight line passing between the half past three and half past eight positions on the dial.

These aesthetic considerations are particularly valid for watches with a round dial. By using a case and a dial of a different shape, the problem may arise in a different way. It has been however noted that, in most cases, the angle at the apex is comprised between 120 and 180°.

In other words, as soon as axes B—B and E—E exceed sectors defined by lines connecting 4 o'clock and 10 o'clock on the one hand, and 2 o'clock and 8 o'clock on the other hand, the available space decreases so that the displays are too small to be able to be read in favourable conditions.

In order to understand properly how it is possible to make a display having the aforementioned features, reference must be made to FIGS. 2 to 7, which show the essential parts of movement 12 with respect to the invention.

Movement 12 includes a plate 38 on which most of the watch components are mounted, in particular at its centre, a chronograph seconds pinion 40, a cannon-pinion 42 and a cannon wheel 44. These three mobile elements, which respectively carry hands 26, 20 and 16, pivot about axis A—A.

Three other mobile elements, each provided with a shaft identified by the letter a and an intermediate wheel identified by the letter b, respectively bearing the references 46, 48 and 50 respectively complete one revolution in 30 minutes of measured time, 12 hours of measured time and 60 seconds of current time (FIG. 3).

Plate 38 further carries a module 52 formed of a base plate 54 and a bridge 56, rigidly secured to each other by means of screws 57. Module 52 carries, inserted between plate 54 and bridge 56, three intermediate gears 58, 60 and 62 and a reduction train 64.

Figure 5:
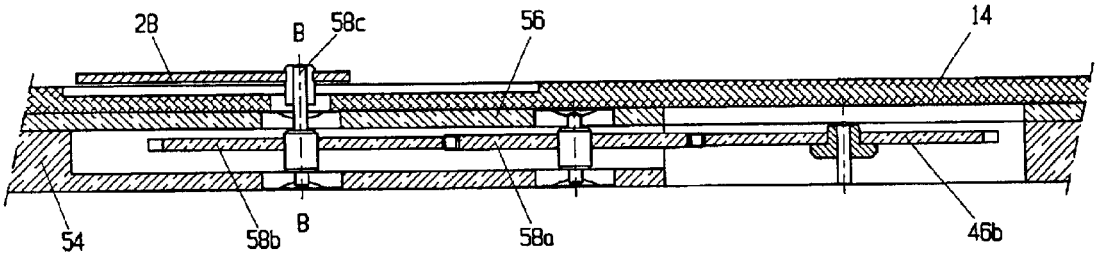

Gear 58, shown in cross-section in FIG. 5, is meshed with intermediate wheel 46*b*. It includes an intermediate wheel 58*a* and a wheel 58*b*, the latter having the same number of teeth as wheel 46*b*, so that wheel 58*b* rotates in the same direction and at the same speed as wheel 46*b*. Wheel 58*b* includes a shaft 58*c* intended to receive the measured time minute hand 28.

Figure 6:
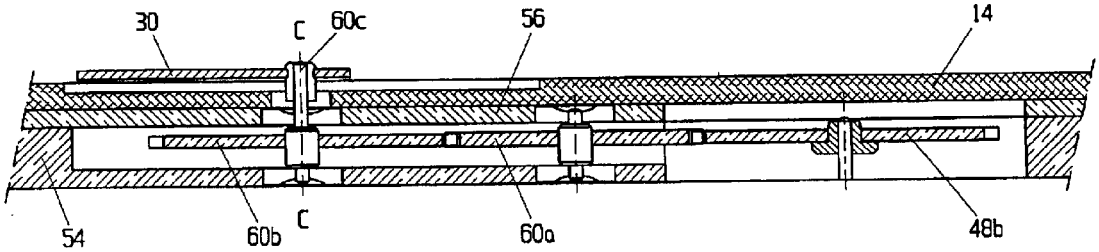

Gear 60, shown in cross-section in FIG. 6, is meshed with intermediate wheel 48*b*. It includes an intermediate wheel 60*a* and a wheel 60*b*, the latter having the same number of teeth as wheel 48*b*, so that wheel 60*b* rotates in the same direction and at the same speed as wheel 48*b*. Wheel 60*b* includes a shaft 60*c* intended to receive measured time hour hand 30.

Figure 7:
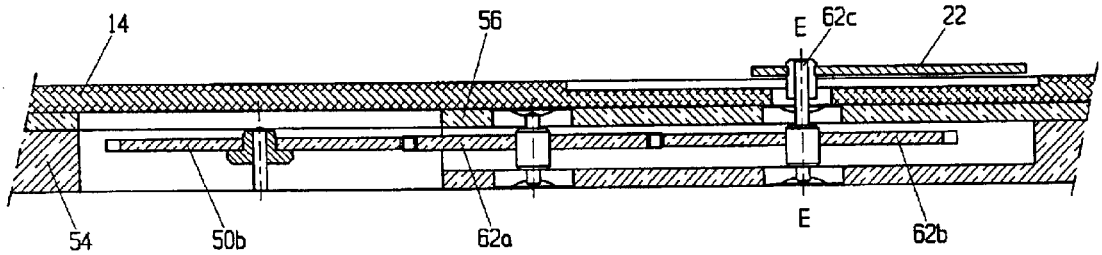

Gear 62, shown in cross-section in FIG. 7, is meshed with intermediate wheel 50*b*. It includes an intermediate wheel 62*a* and a wheel 62*b*, the latter having the same number of teeth as wheel 50*b*, so that wheel 62*b* rotates in the same direction and at the same speed as wheel 50*b*. Wheel 62*b* includes a shaft 62*c* intended to receive the current time seconds hand 22.

Figure 4:
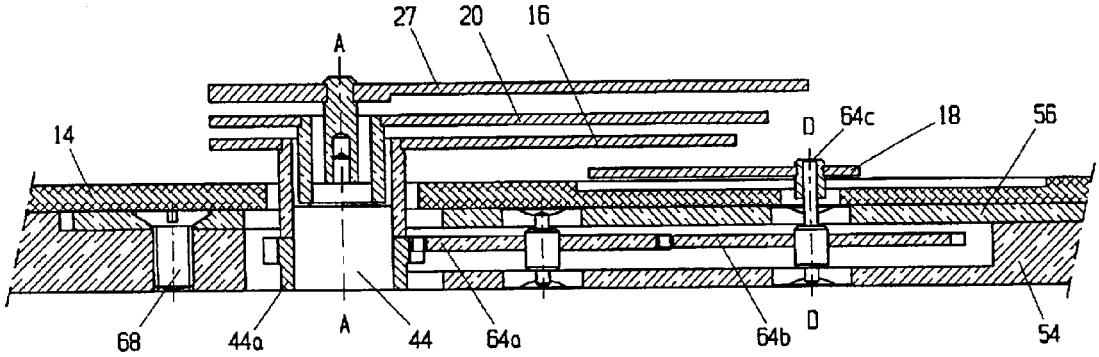
FIGS. 4 to 7 show, in cross-section, gear trains that are specific to this movement.

Finally, reduction train 64, shown in cross-section in FIG. 4, meshes with a pinion 44*a* of cannon wheel 44. It includes an intermediate wheel 64*a* and a wheel 64*b* which has twice as many teeth as pinion 44*a*, so that wheel 64*b* rotates in the same direction and twice as slowly as the cannon wheel, i.e. hour hand 16. Wheel 64*b* includes a shaft 64*c* intended to receive the current time hour hand 18, which completes one revolution in 24 hours.

As can be seen particularly well in FIG. 2, pivoting axes B, C, D and E of wheels 58*b*, 60*b*, 64*b* and 62*b* are arranged in that order, on the horizontal line X—X, which is slightly offset downwards with respect to the centre of the movement.

Module 52 is positioned, in a conventional manner, by means of pins 66 secured to the base plate and engaged in holes in plate 38. It is fixed, for example, by means of screws, which have not been shown in the drawing.

It goes without saying that the movement according to the invention can be the subject of various variants, without thereby departing from the scope of the invention. Thus, the four aligned mobile elements could carry hands assuring the display of different functions to those described.

It would also be possible to place the straight line, on which the four axes are aligned, vertically, for example for countries in which one reads from top to bottom.

What is claimed is:

1. A watch movement with hand display, including mobile elements, intended to receive the hour and minute hands of the current time, mounted so as to pivot about a first axis arranged substantially at the centre of the movement and four mobile elements intended to receive hands for displaying complementary functions, wherein the four mobile elements are mounted so as to pivot on the movement about second, third, fourth and fifth axes arranged on a straight line which is perpendicular to them.

2. A movement according to claim 1, wherein the second and fifth axes form, with the first axis the apex of an isoceles triangle whose base rests on said straight line, the angle at the apex being comprised between 120° and 180°.

3. A movement according to claim 2, wherein said straight line passes below a line passing from 3 to 9 o'clock, through the centre of the movement.

4. A movement according to claim 2, wherein the angle at the apex is substantially equal to 140°.

5. A movement according to claim 1, wherein said movement is of the chronograph type and includes a mobile element intended to carry a measured time seconds hand concentric to said hour and minute hands, and wherein, among said four mobile elements, three of them are intended to display respectively the minute and the hour of the measured time and the seconds of the current time.

6. A movement according to claim 5, wherein the fourth mobile element is intended to display the 24 hours of the day.

7. A movement according to claim 1, including a plate intended to carry its different components, and wherein said four mobile elements are arranged on a module, itself mounted on the plate, each of the four mobile elements being kinematically connected to a mobile element pivoting in the plate.

8. A movement according to claim 3, wherein the angle at the apex is substantially equal to 140°.

9. A movement according to claim 3, wherein said movement is of the chronograph type and includes a mobile element intended to carry a measured time seconds hand concentric to said hour and minute hands, and wherein, among said four mobile elements, three of them are intended to display respectively the minute and the hour of the measured time and the seconds of the current time.

10. A movement according to claim 4, wherein said movement is of the chronograph type and includes a mobile element intended to carry a measured time seconds hand concentric to said hour and minute hands, and wherein, among said four mobile elements, three of them are intended to display respectively the minute and the hour of the measured time and the seconds of the current time.

11. A movement according to claim 3, including a plate intended to carry its different components, and wherein said four mobile elements are arranged on a module, itself mounted on the plate, each of the four mobile elements being kinematically connected to a mobile element pivoting in the plate.

12. A movement according to claim 4, including a plate intended to carry its different components, and wherein said four mobile elements are arranged on a module, itself mounted on the plate, each of the four mobile elements being kinematically connected to a mobile element pivoting in the plate.

13. A movement according to claim 5, including a plate intended to carry its different components, and wherein said four mobile elements are arranged on a module, itself mounted on the plate, each of the four mobile elements being kinematically connected to a mobile element pivoting in the plate.

14. A movement according to claim 6, including a plate intended to carry its different components, and wherein said four mobile elements are arranged on a module, itself mounted on the plate, each of the four mobile elements being kinematically connected to a mobile element pivoting in the plate.

15. A watch movement comprising:

a dial;

a main axis arranged substantially perpendicular to said dial;

a current hour hand pivotally mounted on said dial to rotate about said first axis;

a current minute hand pivotally mounted on said dial to also rotate about said first axis;

a plurality of aligned axes arranged substantially perpendicular to said dial and arranged along a substantially straight line passing substantially perpendicularly through said plurality of aligned axes;

a plurality of additional hands each pivoting around one of said plurality of aligned axes, wherein a measured seconds hand pivots around said main axis, a first of said additional hands displays current seconds, a second of said additional hands displays measured minutes and a third of said additional hands displays measured hours.

16. A movement according to claim 5, wherein:

a fourth of said additional hands displays 24 hour current time.

* * * * *